United States Patent [19]

Fantin

[11] Patent Number: 4,546,498

[45] Date of Patent: Oct. 15, 1985

[54] ELECTRICALLY POWERED DEVICE FOR OPENING AND CLOSING THE VISOR OF A CRASH HELMET

[76] Inventor: Lino Fantin, Via Palazzon 27, Campodoro (Province Padova), Italy

[21] Appl. No.: 472,437

[22] Filed: Mar. 7, 1983

[30] Foreign Application Priority Data

Mar. 8, 1982 [IT] Italy ..... 41527 A/82

[51] Int. Cl.[4] ..... A42B 3/02

[52] U.S. Cl. ..... 2/424; 2/8; 2/10

[58] Field of Search ..... 2/424, 422, 410, 6, 2/8, 9, 10

[56] References Cited

U.S. PATENT DOCUMENTS

| | | | |
|---|---|---|---|
| 2,122,923 | 7/1938 | Yettner | 2/8 |
| 2,417,883 | 3/1947 | Oschin | 2/8 |
| 3,833,936 | 9/1974 | LoGuidice | 2/8 |
| 4,247,960 | 2/1981 | Nava | 2/424 |
| 4,297,747 | 11/1981 | Nava | 2/424 |

FOREIGN PATENT DOCUMENTS

| | | | |
|---|---|---|---|
| 2326156 | 4/1977 | France | 2/424 |
| 2337165 | 8/1978 | France . | |
| 2438229 | 4/1980 | France . | |

*Primary Examiner*—Peter Nerbun
*Attorney, Agent, or Firm*—Guido Modiano; Albert Josif

[57] ABSTRACT

The device comprises a small electric motor driving, through reduction gearing, a gear segment associated with the visor pivot point. The gear segment has a configuration which includes a quarter of a circle and a straight portion which imparts the visor with an initial forward movement followed by a pivotal movement during the opening phase, and vice versa during the closing phase.

3 Claims, 5 Drawing Figures

ELECTRICALLY POWERED DEVICE FOR OPENING AND CLOSING THE VISOR OF A CRASH HELMET

BACKGROUND OF THE INVENTION

This invention relates to an electrically powered device for opening and closing the visor of a crash helmet, particularly useful in motorcycling applications.

As a rule, visors for crash helmets, in motorcycling or sport applications, are associated with the helmet skullcap either by simple journalling with snap locating means, or by snap engagement means which provide for the visor forward movmement by releasing it from its seat and enabling the subsequent opening movement thereof by rotation.

Such means, however, must be operated manually, and quite frequently require the use of both hands by the helmet user, thus being inconvenient to use and potentially dangerous.

SUMMARY OF THE INVENTION

It is an object of this invention to provide a device which affords the possibility of opening and closing the visor of a crash helmet.

A consequent primary object of the invention is to provide a device which can effect the visor opening and closing mechanically through a suitable power means.

Another object is to provide a device which can be actuated with one hand by the helmet user.

It is a further object to provide a device of small size which can be accommodated within the skullcap structure of the helmet.

These and other objects, such as will be apparent hereinafter, are achieved by an electrically poweered device for opening and closing the visor of a crash helmet, characterized in that it comprises a small electric motor driving, through transmission means, a gear segment in the shape of a quarter-circle arc followed by a straight region, the movement of said gear segment determining accordingly a translatory movement followed by a rotation (or vice versa), one end of the helmet visor being associated with said gear segment.

Mounted on the helmet are two such devices, positioned at the visor pivot points, said devices being powered by batteries contained in the padding of the helmet skullcap with the interposition of a reversing switch.

BRIEF DESCRIPTION OF THE DRAWINGS

Further features and advangtages of the invention will be apparent from the following detailed description of a preferred embodiment thereof, as illustrated by way of example in the accompanying drawings, where.

DESCRIPTION OF THE PREFERRED EMBODIMENT

Figure 5:
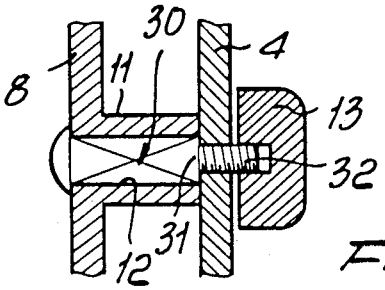
FIG. 5 is a section according to line V—V of FIG. 4, shown in an enlarged scale and out of proportions for the sake of clarity.
Figure 1:
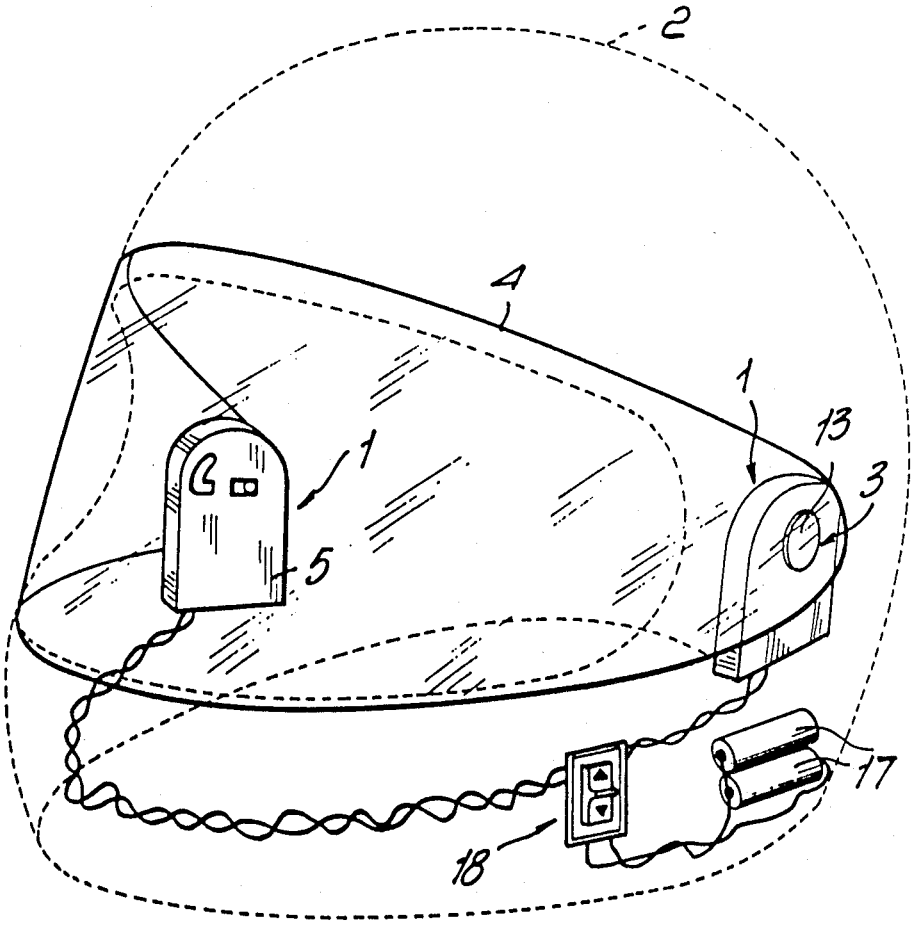
FIG. 1 is a diagrammatical ghost view of a crash helmet incorporating a visor equipped with devices according to this invention.

Making reference to the drawing figures, this device, generally indicated at 1 and being invariably mounted in pairs, is positioned within the padding of the skullcap 2 of a motorcyclist's crash helmet at the temple regions, at the points 3 of connection to the visor 4.

The device 1 comprises fixed on the helmet a flattened casing 5 which contains a small electric motor 6 which drives, through reduction gearing 7, a gear segment 8, movably supported on the casing 5.

Said gear segment 8 has its teeth arranged along a first rectilinear region 9 and second consecutive region 10 in the shape of an arc of a circle.

Said segment 8 further includes a first pin 11 formed with a square-sectioned bore 12, where through a means, such as a screw having an outside boss 13, is inserted which fastens the visor 4 to the gear segment 8. It will be understood that the screw 30 has a square-sectioned shaft portion 31 which fits within the bore 12 and a threaded end portion 32 extending beyond said bore 12 and in screwing engagement with the boss 13. The adjacent wall of the visor 4 is provided with a hole through which the screw is passed and is arranged between the boss 13 and the segment 8, where it is fixed when the boss 13 is screwed.

Said first pin 11 can be moved along a slot 14 formed in the walls of the casing 5, and is also allowed to rotate about itself, the circular outer periphery of the pin 11 being in slidable engagement with the slot 14.

Said gear segment 8 further includes a second pin 15 which can move along a cam 16 comprising a rectilinear portion **16*a* followed by a portion 16*b* in the shape of an arc of a circle. The ends of the rectilinear portion 16*a* and the arcuated portion 16*b* provide limits defining the movement of the pin 15** segment therein.

Said cam 16 is formed on the walls of the casing 5, and its portion **16*a* has a length dimension such that the same travel range is afforded for the pin 15 as the slot 14 affords to the pin 11**.

Figure 2:
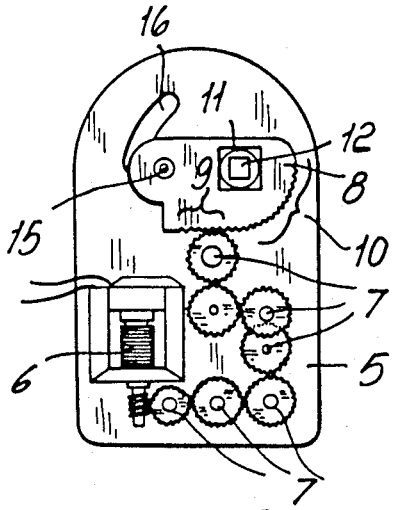
FIG. 2 shows the power drive and gearing of this device.
Figure 3:
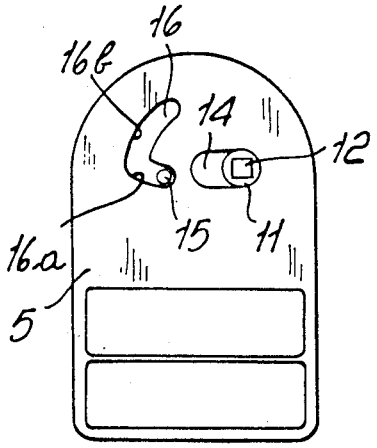
FIG. 3 is an external view of the casing containing this device, showing a cam operative to enable the translatory and rotational movements of the visor attachment point.

Upon actuation of the electric motor 6, the last gear in the gear train indicated at 7, which meshes with the gear segment 8, will drive the latter to move (from the position shown in FIG. 2) first leftwards as far as allowed by the slot 14, and then rotatively about the pin 11 under the guide of the pin within the cam 16.

The cam 16 is configured such that, during the rotational movement of the gear segment 8, the teeth of the region 10 always mesh with the gear of the reduction gearing.

When the motor 6, which is of a DC type, is supplied with a reverse polarity current, an opposed sequence of movements of the gear segment 8 occurs.

Figure 4:
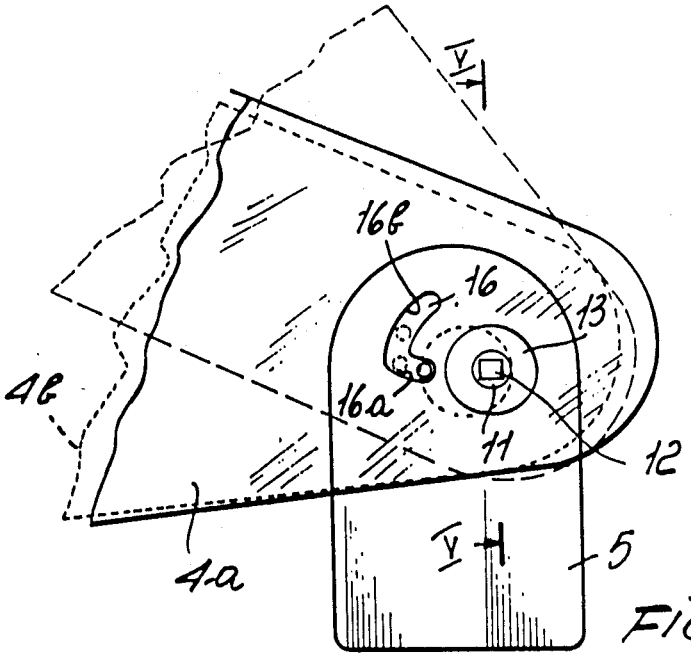
FIG. 4 illustrates the visor path of movement.

The gear segment 8 is, as mentioned, made rigid with the visor, which as shown in FIG. 4, will move from a position **4*a*, corresponding to the closed position of the visor, into a position 4*b*, which corresponds to a position whereat the visor has been translated to no longer interfere with the skullcap 2** of the helmet, and be then rotated to occupy a position corresponding to that of partial opening of the visor.

For powering the motors 6 of the device, formed within the skullcap 2 is an accessible space which contains electric batteries 17. The powering circuit includes a reversing switch 18 which has a shut-off center position and two symmetrically arranged side positions whereat the motors are powered with opposed polarity currents to cause the visor to open or close.

Inside the casings 5 (or at some other suitable locations), travel limit switches are provided, not shown in the drawings, which disconnect the motors with the visor in its fully open or fully closed positions, respectively.

Said reversing switch is located inside the skullcap 2 at a convenient position for operation with one finger.

It will be appreciated from the foregoing description that the invention fully achieves its objects by providing a device which enables the opening and closing movements of the visor to be power produced in a crash helmet.

The device imparts the visor with a translatory movement which releases it from the recessed area where it is received in its fully closed position, to then allow it to be rotated.

The visor may be locked at any opened positions, since it is connected rigidly to the mechanical reduction set.

Operation is quite simple, and requires of the helmet user no manipulations or operations involving the use of both hands, such as might be potentially dangerous.

The whole device and ancillary members thereof are contained within a flattened casing which is accommodated within the thickness of the helmet padding, thus being reliable and safe.

Of course the materials and dimensions may be any selected ones to meet individual requirements.

I claim:

1. An electrically powered device for opening and closing the visor of a crash helmet comprising:

a casing positioned within the temple regions of the motorcyclist's crash helmet;

an electric motor including a reduction gearing and housed in said casing;

a gear segment movably supported on said casing and driven by said motor through said reduction gearing;

a slot formed in the walls of said casing;

a first pin mounted for rotation together with and projecting from said gear segment slidably engaging in said slot and connecting the visor ends to said gear segment;

a cam comprising a first rectilinear portion followed by a second portion in the shape of an arc of a circle, a second pin projecting from said gear segment and engaging in said cam;

the first portion of said cam having limits, which define a stroke of said second pin, which is equal to the stroke allowed to said first pin by said slot, so that when a rotatory motion is imparted by the motor to the reduction gearing, this rotatory motion is converted first in a linear motion of the gear segment and thereafter the rotatory motion is transmitted to the gear segment, when said gear segment reaches a rotatory condition.

2. A device, as claimed in claim 1, wherein an accessible space is formed within said crash helmet housing electric batteries for powering said motor.

3. A device, as claimed in claim 1, comprising a reversing switch, which has a shut-off center position and two symmetrically arranged side positions each corresponding to reverse polarity feeding, whereby the motors are powered with opposed polarity currents to cause the visor to open or close.

* * * * *